United States Patent [19]

Finamore

[11] Patent Number: 4,517,999

[45] Date of Patent: May 21, 1985

[54] HAIRPIECE AND METHOD OF MAKING SAME

[76] Inventor: Paul V. Finamore, 5525 N. Pioneer Ave., Chicago, Ill. 60656

[21] Appl. No.: 626,310

[22] Filed: Jun. 29, 1984

Related U.S. Application Data

[63] Continuation-in-part of Ser. No. 446,242, Dec. 2, 1982, abandoned.

[51] Int. Cl.[3] ..... A41G 5/00

[52] U.S. Cl. ..... 132/53; 132/5

[58] Field of Search ..... 132/53, 54, 55, 5

[56] References Cited

U.S. PATENT DOCUMENTS

| | | | |
|---|---|---|---|
| 1,490,466 | 4/1924 | Brehmer | 132/56 |
| 2,736,325 | 2/1956 | Dvorzsak | 132/53 |
| 2,814,301 | 11/1957 | Schmitz | 132/5 |
| 2,907,334 | 10/1959 | LeMole | 132/5 |
| 3,420,249 | 1/1969 | Bonham | 132/53 |
| 3,421,521 | 1/1969 | Rich | 132/5 |
| 3,435,831 | 4/1969 | Nakayama et al. | 132/53 |
| 3,472,246 | 10/1969 | Ostrom | 132/53 |
| 3,520,309 | 7/1970 | Lane et al. | 132/53 |
| 3,613,695 | 10/1971 | Kazdin | 132/53 |
| 3,659,621 | 5/1972 | Tucciarone et al. | 132/53 |
| 3,716,065 | 2/1973 | Finamore | 132/53 |
| 3,834,403 | 9/1974 | Ahn | 132/53 |
| 3,868,959 | 3/1975 | Koh | 132/53 |
| 3,970,092 | 7/1976 | Nelson | 132/53 |
| 3,971,392 | 7/1976 | Brehmer | 132/53 |
| 4,296,765 | 10/1981 | Bachtell | 132/53 |
| 4,453,555 | 6/1984 | Finamore | 132/53 |
| 4,456,019 | 6/1984 | Finamore | 132/53 |

FOREIGN PATENT DOCUMENTS

| | | | |
|---|---|---|---|
| 1255711 | 12/1971 | United Kingdom | 132/53 |

*Primary Examiner*—Richard J. Apley
*Assistant Examiner*—Carolyn A. Harrison
*Attorney, Agent, or Firm*—Trexler, Bushnell & Wolters, Ltd.

[57] ABSTRACT

A superbly fitting hairpiece foundation comprising a flexible-sheet member and a reticulate member is disclosed. The flexible-sheet member has a predetermined curvature and is adapted substantially to conform to the head of a particular user. The sheet member has at least one hole sufficient in size for permitting substantial dissipation of heat or perspiration or both away from the head and through the sheet member. The reticulate member is attached to the sheet member and covers the hole or holes. The reticulate member includes a plurality of openings which provide adequate surface area, in the aggregate, for permitting the above-mentioned dissipation phenomen on to occur thereby permitting the user with a relative degree of comfort.

25 Claims, 15 Drawing Figures

10
12
14
16
18
20
21
22
24
15
3

HAIRPIECE AND METHOD OF MAKING SAME

CROSS-REFERENCE TO RELATED APPLICATIONS

This application is a continuation-in-part of an earlier application, Ser. No. 446,242, filed Dec. 2, 1982 and entitled HAIRPIECE FOUNDATION, the benefit of which is now claimed under 35 U.S.C. Section 120 and now abandoned.

The present application is also directed to subject matter similar to that disclosed in two currently pending patent applications, which have been assinged to Hairline Creations, Inc. of Chicago, Ill., the assignee of this application. The first application, filed May 18, 1983 and bearing Ser. No. 494,695, is entitled "HAIRPIECE AND METHOD OF MAKING SAME". The second application, filed Aug. 23, 1982 and bearing Ser. No. 410,421, is entitled "HAIRPIECE FOUNDATION AND METHOD OF MAKING SAME". Both of these applications are hereby incorporated by reference.

BACKGROUND OF THE INVENTION

The present invention is directed to the hairpiece fabrication arts and more particularly to a novel and improved hairpiece and hairpiece foundation and the method for making such a hairpiece and hairpiece foundation.

The present application discloses a novel hairpiece foundation of practical design which overcomes many of the inadequacies of heretofore available hairpiece foundations.

Up to the present time, most commercially available hairpiece foundations have been substantially one-piece sheets or members (see, for example, U.S. Pat. No. 2,736,325 to Dvorzsak, column 1, lines 64–71, and U.S. Pat. No. 2,907,334 to LeMole, column 4, lines 47–61) containing essentially no breather holes in relation to the amount of surface area to be covered. Such hairpiece foundations either do not permit the pores of the head of the wearer adequately to breath or do not otherwise provide for the comfort of the wearer. Nor have compound hairpiece foundations provided adequate breather holes. (See, for example, U.S. Pat. No. 3,520,309 to Lane et al, column 3, lines 39–42). Inadequate dissipation of body heat from the head of the wearer, or the effects of perspiration, either have caused discomfort to the hairpiece wearer or otherwise have become a cause of embarassment.

Suggestions posed in the art directed toward incorporation of aromatic substances into hairpiece foundations to counteract the effects of perspiration (see, for example, U.S. Pat. No. 1,490,466 to Hupka, column 2, lines 69–71) either have not been found to be entirely practical or have not otherwise been entirely possible. Moreover, many porous materials (such as cloth), which have heretofore been used in the manufacture of hairpiece foundations, have a tendency to rot or otherwise disintegrate over a period of time from proximity to normal body acids, such as a result from perspiration.

OBJECTS AND SUMMARY OF THE INVENTION

Accordingly, it is a general object of this invention to provide a novel and improved hairpiece.

A more specific object is to provide a hairpiece which is relatively comfortable when worn.

A yet further object is to provide a hairpiece adapted to provide substantial dissipation of heat or perspiration or both away from the head of the wearer.

Wigmakers, aware of the need of human comfort in relation to hairpiece foundations, have suggested that dissipation of heat or perspiration or both can be accomplished by providing the hairpiece foundation with perforations. (See, for example, U.S. Pat. No. 3,971,392 to Brehmer at column 2, lines 7–10; U.S. Pat. No. 3,613,695 to Kazdin at column 2, lines 57–61; U.S. Pat. No. 3,472,246 to Ostrom at column 4, lines 11–15; or British Pat. No. 1,255,711 to Stewart at page 1, lines 68–76). The art suggests that dissipation of heat or perspiration or both is a diffusion phenomenon. It has been discovered, however, that dissipation, sufficient to provide the wearer with a reasonable degree of comfort, is a combination of convection and conduction phenomena, which requires that the hairpiece foundation be provided with a substantial amount of open area. It has further been discovered that providing a one-piece hairpiece foundation with a reasonable number of perforations or other holes (as such are defined in the above-referenced patents) does not provide sufficient open area.

Therefore, briefly, and in accordance with the foregoing objects, a hairpiece according to the present invention comprises a flexible-sheet member and a reticulate member. The flexible-sheet member has a predetermined curvature and is adapted substantially to conform to the head of a preselected user. The sheet member has hole means therethrough sufficient in size for permitting substantial dissipation of heat or perspiration or both away from the head and through the sheet member. Reticulate member means is attached to the sheet member and covers the hole means. The reticulate member means includes a plurality of openings which provide means for permitting the above-mentioned dissipation to occur.

BRIEF DESCRIPTION OF THE DRAWINGS

The foregoing, as well as other objects, features and advantages of the present invention will become more readily understood upon reading the following detailed description of the illustrated embodiment, together with reference to the drawings, wherein.

DETAILED DESCRIPTION OF THE ILLUSTRATED EMBODIMENT

Figures 1, 2, 3, 4:
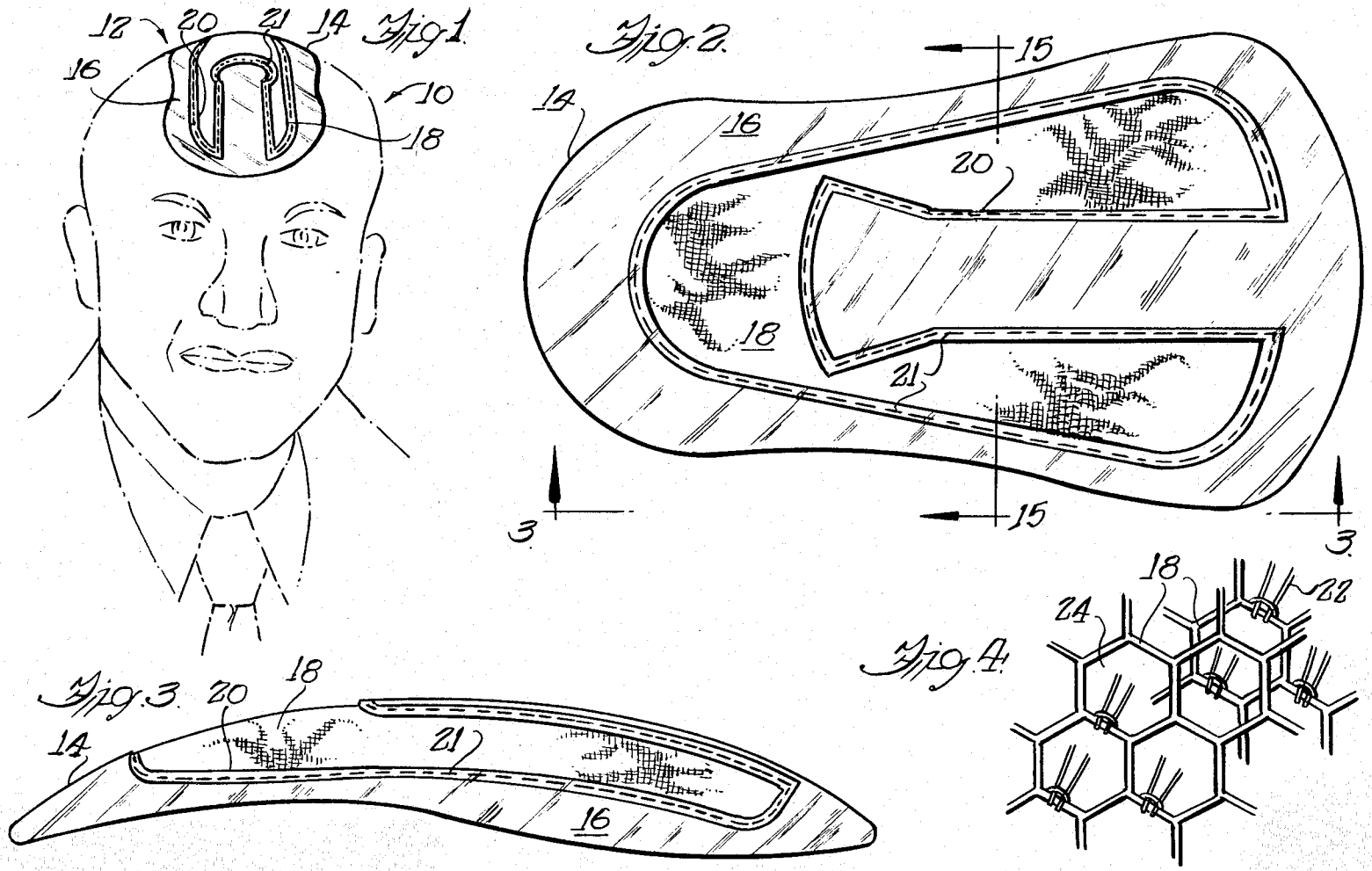
FIG. 1 is a view of a novel hairpiece foundation, in perspective, as worn on the head of a person.
FIG. 2 is a top view of a first embodiment of the hairpiece foundation of the present invention.
FIG. 3 is an end view taken along the lines 3—3 in FIG. 2.
FIG. 4 is a view, partially in section and on an enlarged scale, showing a reticulate member of the hairpiece foundation of FIGS. 2 and 3, and a manner of attaching hair to the reticulate member.

Referring first to FIG. 1 there is illustrated the head 10 of an individual having a bald area 12 which is to be covered by a hairpiece (not shown) having a hairpiece foundation 14. Although I prefer to use the instant invention in combination with hairpiece foundations disclosed in my above-referenced applications, it can be appreciated that the instant invention can be used in connection with other hairpiece foundations.

The hairpiece foundations of the above-referenced applications are, briefly stated, substantially resistant to perspiration and substantially impervious to deterioration resulting from exposure to such perspiration or substances contained therein. These hairpiece foundations are also generally impervious to deterioration resulting from exposure to heat. The above-referenced application bearing Ser. No. 347,622, for example, discloses a flexible-sheet member comprising a sheet of polyurethane film, and the application bearing Ser. No. 410,421 discloses a composite flexible-sheet member comprising separate sheets of polyurethane film as respective inner and outer surfaces thereof.

For proper fit and other comfort reasons, it is desirable to cause the flexible-sheet member 16 to conform substantially to the curvature of the head 10, and particularly to the bald area 12, of the individual for whom the hairpiece is to be made (see FIGS. 1, 3). This can easily be accomplished by using methods disclosed in my above-referenced applications. Briefly, this comprises vacuum-forming and heat-treating the flexible-sheet member 16 to cause the member 16 to assume a predetermined curvature. A reticulate member 18 which is flexible and preshapable substantially to the curvature of the head of the wearer is preferably used.

At times, it has been found desirable to incorporate, into the manufacturing steps of the instant invention, methods (such as those methods outlined in the application bearing Ser. No. 347,622 to blend the edge boundaries of the hairpiece foundation 14 into the scalp or bald area 12 of the wearer, or such as those methods outlined in the application bearing Ser. No. 410,421 to provide the hairpiece foundation 14 with a pore-like appearance) to further provide the hairpiece foundation 14 with a truly natural appearance.

In addition to having appearance-related features, it is also generally desirable that hairpiece foundations include comfort-related features.

Discomfort to the hairpiece wearer can, and generally does, come about because heat or perspiration or both accumulate in an envelope or region, which is located intermediate the hairpiece foundation and the head of the wearer. It has been discovered that to relieve such discomfort, it is necessary to provide for adequate dissipation of the heat or the perspiration or both from the envelope or region.

Several well-known attempts at relieving such discomfort have been directed toward providing the hairpiece foundation with a plurality of perforations or other holes. Such holes, however, are generally relatively small in diameter in relation to the thickness of the hairpiece foundation for which they are provided. In addition, for many of such hairpiece foundations (which include such holes) distances between adjacent holes are at least as great as, and often are substantially greater than, diameters of such adjacent holes.

The prior art implies that adequate dissipation of heat or perspiration or both from the envelope or region, for purposes of relieving such discomfort, is achieved by providing the hairpiece foundation with means for permitting diffusion of heat or perspiration or both from the region. It has been discovered, however, that dissipation of heat or perspiration or both for purposes of relieving discomfort is not a diffusion phenomenon but rather is a convection and a conduction phenomenon.

Accordingly, it has been found that such discomfort is substantially relieved by providing the hairpiece foundation 14 with a plurality of holes, each such hole being relatively large in diameter in relation to the thickness of the hairpiece foundation 14. A 10-mil thick hairpiece foundation, for example, may include a dozen dime-sized holes, in accordance with the present invention. The hairpiece foundation 14, presented in FIG. 2, includes a single, U-shaped hole 20 for illustrative purposes. The hole 20 is substantially centrally located upon the surface of the sheet member 16.

Factors affecting dissipation of heat or perspiration or both will, of course, vary from individual to individual. For most individuals, a single hole or a plurality of holes in the aggregate must provide the hairpiece foundation with a substantial amount of open area in relation to the total area of the hairpiece foundation. Accordingly, for adequate dissipation of heat or perspiration or both for purposes of providing for the comfort of the wearer, it has been found that the amount of open space afforded by the hole 20 ought to range from about 20% to about 60% in relation to the area of the hairpiece foundation 14. As presented in FIG. 2, for example, the hole 20 through the member 16 accounts for about 40% of the surface area of the hairpiece foundation 14.

The reticulate member 18 is preferably a two-sheet mesh (see FIG. 4) comprising gauze of silk suitably treated to be resistant to perspiration and heat. The mesh is dyable to a wide variety of shades or hues of color and is therefore capable of providing the hairpiece foundation 14 with a truly natural appearance. Accordingly, the mesh is preferably dyed to match the color of the scalp of the wearer or the color of the hair to be added to the hairpiece foundation 14. It is well known in the art that conventional hairpiece foundations which incorporate mesh generally do not have a natural appearance. (See, for example, U.S. Pat. No. 3,435,831 to Nakayama et al at column 1, lines 25–29).

Although it has been found desirable to secure the hairpiece foundation 14 to the head 10 using double-sided medical tape (not shown), it can be appreciated that a wide variety of normally-tacky, pressure-sensitive devices or substances can be used for such a purpose.

The reticulate member 18 covers the hole 20. The reticulate member 18 has dimensions slightly larger than the hole 20 so that the perimeter of the reticulate member 18 overlaps the periphery of the hole 20 (see FIG. 2). The respective edge boundaries of the reticulate member 18 and the sheet member 16 at the hole 20 are then sewn together using thread capable of providing appropriately spaced and sized stitches 21, as shown in FIGS. 1–3, for securely holding the flexible-sheet member 16 and reticulate member 18 together. It has been found desirable to use a thread which is dyable to as wide a variety of colors as the mesh.

In the instant invention, it can be appreciated that for a hairpiece foundation (embodiment not shown) which has a plurality of convection- and conduction-phenomena affording holes, each such hole is thus respectively covered by a suitably sized reticulate member in accordance with the present invention.

To fasten hair to the flexible-sheet member 16 of the hairpiece foundation 14 (such fastening of hair not being presented in FIGS. 1–3), a variety of methods can be employed. Preferred methods are disclosed in my above-referenced applications. Briefly, these preferred hair-fastening methods first provide for puncturing the flexible-sheet member 16 and causing hair to be drawn through such a puncture. Such methods then provide for puncturing the flexible-sheet member 16 a second time and causing the hair to be drawn back through the second puncture. The hair can be natural or artificial and can be a single fiber or a collection of fibers.

The hair 22 is secured to the reticulate member 18 by well-known looped knots (FIG. 4). An individual hole or opening 24 through the mesh of the reticulate member 18 is relatively substantially greater in diameter (or as expressed by other appropriate linear dimension) than the diameter of an individual hair 22 knotted or otherwise attached to the mesh.

Individual openings 24 of the reticulate member 18 are sufficiently large, as to open area, so that the plurality of openings 24 in the aggregate does not interfere with the dissipation of heat or perspiration or both from the above-described region of the wearer. Rather, the amount of open surface area provided by the plurality of holes or openings 24, in the aggregate, is only slightly less than the amount of open area provided by the hole 20.

Figure 5:
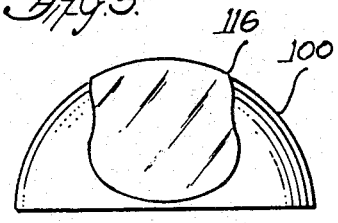
FIG. 5 is an elevation of a form or shell on which an elastic sheet member forming a part of a hairpiece in accordance with a second embodiment of the invention is being formed.

Thus, the hairpiece foundation 14 is relatively comfortable to wear and superbly fitting. Reference is next invited to FIGS. 5 through 14 wherein there is illustrated a hairpiece and a method for making this hairpiece in accordance with a second embodiment of the invention. Referring initially to FIG. 5, a rigid polymer hard shell or form 100 is formed or designed on a mold to generally conform to the contour of the top portion of the head of the intended wearer or user. This formation of the hard shell or form 100 is more fully described in the above-referenced applications, Ser. No. 494,695 and Ser. No. 410,421, and need not be further described herein.

A flexible sheet member 116 is preferably fabricated from an elastomer film vacuum formed on the hard shell or form 100 in substantially the same fashion as described above with reference to the flexible sheet member 16. This is also preferably in accordance with the methods and utilizing the materials discussed for formation of the flexible sheet member in the two above-referenced applications. The flexible sheet member 116 will now conform to the contour of the portion of the intended wearer's head upon which the hairpiece is intended to be worn. Preferably, the sheet member 116 comprises a polyester-based thermoplastic polyurethane film having a thickness of on the order of 4 mils. Such a material is more fully described in the above-referenced applications.

Figure 6:
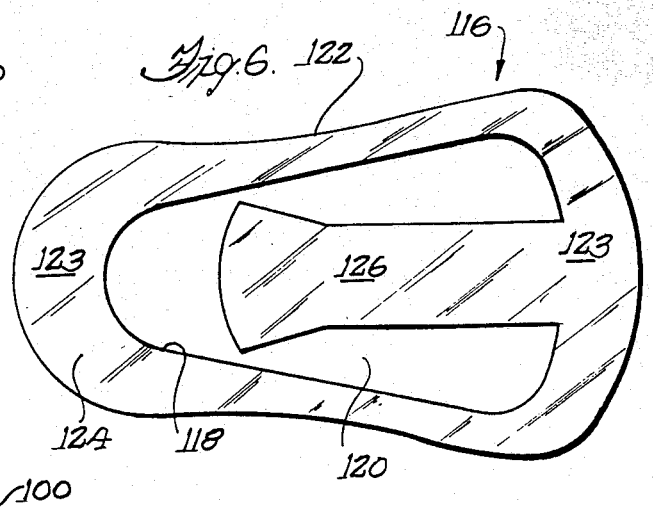
FIG. 6 is an enlarged top plan view of the elastic sheet member of FIG. 5, and illustrating further shaping thereof.

Referring now to FIG. 6, the flexible sheet member is next designed or cut to the desired shape. In accordance with a feature of the invention, an interior area or surface portion of the flexible sheet member 116 is cut away about a line or edge 118 to leave a substantial open portion or through opening 120 therein. Preferably, this through opening or open area 120 is from about 20 percent to 60 percent of the area of the sheet 116. This cutting or shaping at edges 118 will be further seen to define, with an outer edge 122, a peripheral margin surface or portion 124 of the flexible sheet member 116 which generally surrounds the opening 120 and is of a generally annular configuration when viewed in plan as in FIG. 6. In accordance with the embodiment illustrated, the peripheral margin portion 124 further includes a transverse or tongue portion or projection 126 integral therewith which extends inwardly, that is, into the otherwise open area or through opening 120. The margin 124 and tongue 126 also define a top or outer surface 123 and a bottom or inner surface 125 (see FIG. 7).

It will be understood that the opening 120 may be of a different shape or configuration, as may be the contour or shape of the margin portion 124 and inwardly projecting tongue 126 without departing from the invention. In this regard, a part area may also be formed as a portion of the opening 120 to one or the other side of the inward projection or tongue 126 generally conforming to a desired area where the hair of the finished hairpiece is to be parted by the wearer, and hence the cut or shaped flexible sheet member need not have the generally symmetrical configuration illustrated in FIG. 6.

Figure 8:
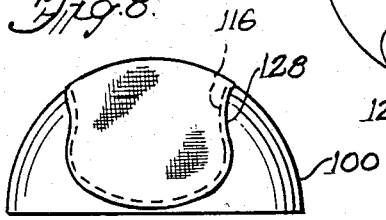
FIG. 8 is a view similar to FIG. 5 showing a further step in the process of fabrication of a hairpiece in accordance with the second embodiment of the invention.
Figure 7:
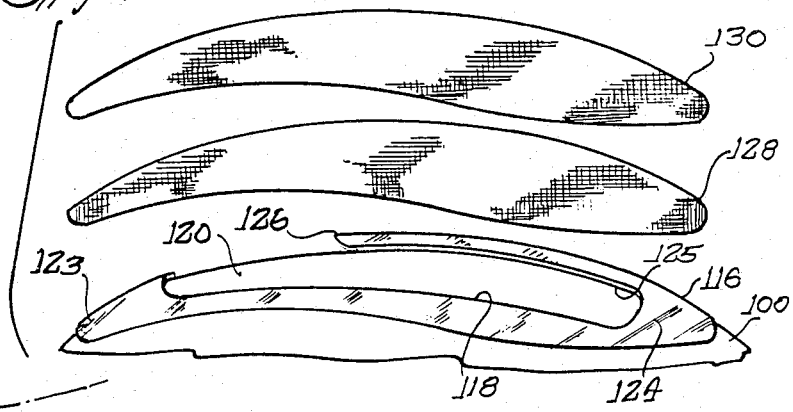
FIG. 7 is an enlarged side elevation illustrating a further step in the process of fabrication of a hairpiece in accordance with a second embodiment of the invention.

Referring now also to FIGS. 7 and 8, in accordance with a feature of the second embodiment of the invention, at least one net, mesh or reticulate sheet or member 128 is provided, and preferably comprises a reticulate or mesh-like sheet fabricated of monofilament nylon fiber. This mesh or reticulate sheet 128 is initially soaked in boiling water to soften sufficiently to be shaped and is thereafter stretched and blocked on the hard shell or form 100 over the flexible sheet member 116. Advantageously, this soaking, stretching and blocking has been found to substantially prevent hairs inverting at a later time, after the hair has been added to the foundation comprising the flexible sheet member 116 and net or reticulate sheet 128, as will be described later.

In accordance with an alternate form of the invention, a second substantially similar nylon mesh or reticulate member 130 may also be utilized and is also preferably soaked in boiling water to soften, and thereafter stretched and blocked on the hard shell over the flexible sheet member 116 and first net or reticulate sheet 128.

The hard shell or form 100 with the sheet members 116, 128 (and 130 if utilized) thereon is then placed in an oven at a temperature of substantially 160 degrees fahrenheit for substantially on the order of one hour to accomplish heat shrinking of the net 128 (and net 130 if utilized) to the contour of the hard shell, form or mold 100 and hence to the contour of the underlying film or flexible sheet member 116.

In this regard, the nets or reticulate sheets 128 and 130 may be initially cut or peripherally shaped to generally the size and shape of the outer periphery 118 of the flexible sheet member 116; however, the reticulate sheets or nets 128, 130 are preferably cut to a somewhat larger peripheral dimension to allow for the shrinking described above. Preferably, the material of the reticulate sheets or members 128 and 130 is an open count, welded monofilament nylon variety. Moreover, the respective mesh or reticulate patterns of the two sheets or nets 128 and 130 may be offset somewhat in the event that two such reticulate members or nets are utilized.

Figure 9:
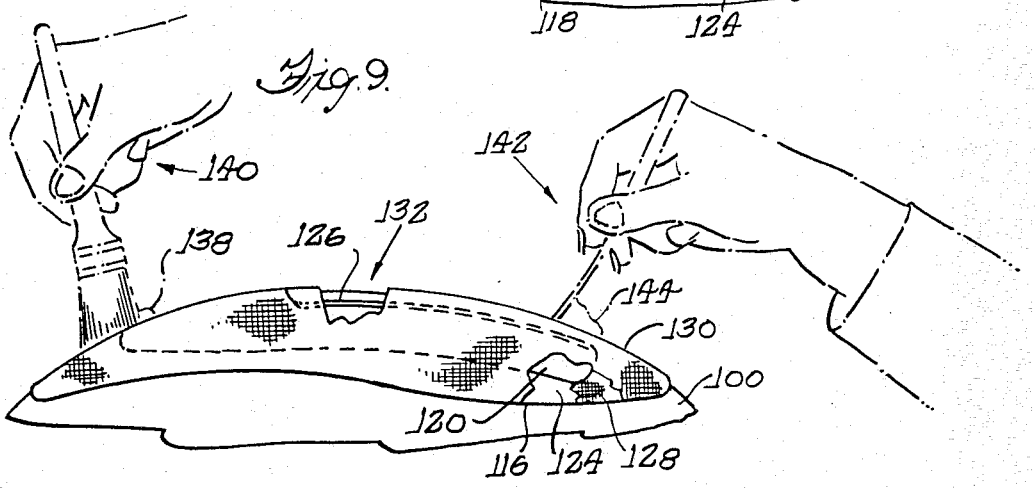
FIG. 9 is an enlarged side elevation, similar to FIG. 7, illustrating yet another step in the process of fabrication of a hairpiece in accordance with the second embodiment of the invention.

The composite structure comprising the flexible sheet 116 with cutout or open area 120 and one or two mesh or reticulate sheet members 128 and 130 may be collectively referred to as a foundation and is designated by general reference numeral 132. The foundation 132, comprising flexible sheet 116 and one or more reticulate sheets 128, 130, as thus far assembled is permitted to dry. Thereafter, a cross linking agent or primer 138 is brush coated through the one or two meshes or reticulate sheets around the areas thereof overlying the margin 124, including the extension or tongue portion 126 thereof. This brush coating is indicated in FIG. 9 generally in phantom line at reference numeral 140. This cross-linking agent or primer is preferably a silicone based cross-linking agent or primer of the type generally described in the above-reference co-pending applications. In the illustrated embodiment this primer preferably comprises a primer of the type generally designated AP-149 solution available for example, from Hughson Chemicals, Lord Corporation, 2000 West Grandview Boulevard, Erie, Pa. 16512. The thus far assembled foundation 132 including flexible sheet 116 and one or more nets or reticulate sheets 128 and 130 with the primer applied thereto as just described is cured in an oven at substantially on the order of 160 degrees fahrenheit for substantially on the order of 30 minutes.

Following application of the primer as indicated at 140, a bonding agent for bonding the reticulate sheet member 128 (and reticulate sheet member 130 of two such members are utilized) to the flexible sheet 116 margin top or outer surface 123 is applied as indicated generally at reference numeral 142 as with a knife, spatula or other suitable tool. This latter bonding agent is indicated generally at 144 and preferably comprises a silicon adhesive or sealant of the type generally described as "elastic organo-silicon-oxide high polymer (coating)" in the above-reference co-pending applications, generally available as number 732 RTV from Dow Corning. This adhesive or sealant 144 is applied over the same area as the primer 140, that is, to and through the portions of the net or nets 128 and 130 which overlie the outer or top surface 123 of peripheral margin portion 124' including the extension or tongue 126 of the flexible sheet member 116. The thus far completed foundation 132 with adhesive sealant applied as just described is next oven cured at a temperature of substantially on the order of 160 degrees fahrenheit for a period of substantially on the order of one hour.

Figure 10:
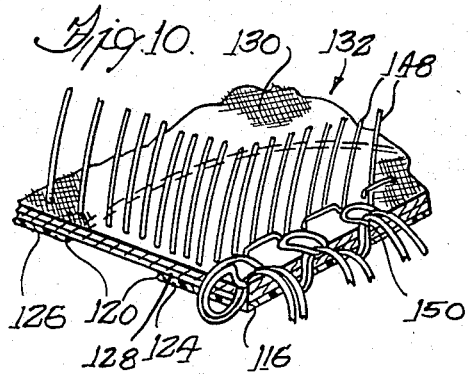
FIG. 10 is an enlarged perspective view, partially in section and partially broken away, illustrating a further step in the process of fabrication in accordance with the second embodiment of the invention.
Figure 11:
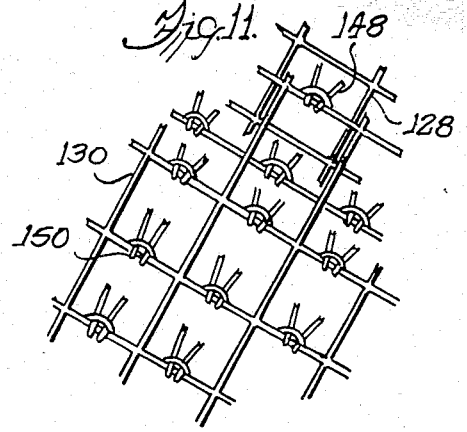
FIG. 11 is a greatly enlarged top plan view of a portion of FIG. 10 illustrating the fabrication step of FIG. 10 in greater detail.

Referring next to FIGS. 10 and 11, hair strands 148 are now secured or "ventilated" to the entire base or foundation 132 both to the topmost mesh 130 (or single mesh 128 if but one mesh is utilized) in the area of the opening 120 and to the entire "lamination" of mesh, film and silicone coating about the peripheral margin 124 and its extension 126. The hair strands 148 may be applied in one or more of the fashions illustrated in the above-mentioned co-pending applications, but preferably is applied in a knotted fashion as indicated generally at 150 in FIG. 10 and at 152 in FIG. 11. The hair strands 148 may be secured or ventilated in single strands or in groups of strands as taught in the above-referenced co-pending applications. If, however, a part area is desired, this would be designed as part of the cutting and shaping of the flexible sheet member 116 as discussed above with reference to FIG. 6; and in this part area, the hair would be secured or ventilated in "pull-through" fashion as also described in the above-referenced co-pending applications. As shown in FIG. 11, the reticular or mesh grid pattern of the reticulate sheets is preferably generally rectilinear. However, other patterns may be utilized without departing from the invention.

Figure 12:
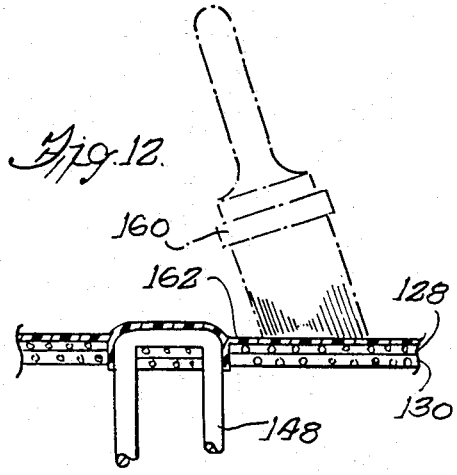
FIGS. 12 and 13 are enlarged sectional views illustrating further steps in the process of fabrication of the hairpiece in accordance with the second embodiment of the invention.

Referring next to FIG. 12, following completion of ventilation or securing of hair to the entire foundation 132, the foundation 132 is removed from the hard shell or form 100, and preferably blocked in an inverted fashion with the bottom of the foundation facing up. Thereafter, adhesive material 162 to fuse the hair to the base may be brush coated in the part or pull-through area, if any, as indicated generally in phantom line at 160. Preferably this adhesive 162 comprises an anaerobic ethyl cyanoacrylate adhesive of the type disclosed in the above-referenced co-pending applications.

Figure 13:
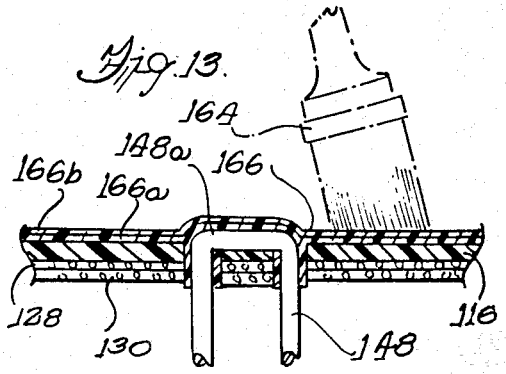

Thereafter and referring now to FIG. 13 a final sealer or coating 166 is brush coated as indicated in phantom line at 164 to the inner surface 125 of the peripheral margin portion 124, including extension 126 thereof, of the flexible sheet member 116. This sealer or coating seals bottom portions **148*a* of hairs 148 which protrude from the underside of sheet 116. This sealer or coating is also preferably applied in the part or pull-through area, if any, to protect the adhesive coating 162 as mentioned above with reference to FIG. 12, from body oils and the like. Preferably, the coating 166 is applied in two or three layers as indicated at 166*a*, 166*b***. Moreover, after application of each layer of coating, the just-applied coating is preferably cured under warm forced air dryers, the temperature of the dryers being controlled so as not to re-heat and re-shape the nylon mesh material or reticulate members which were previously heat shaped to conform to the desired contour, as described above.

Figure 14:
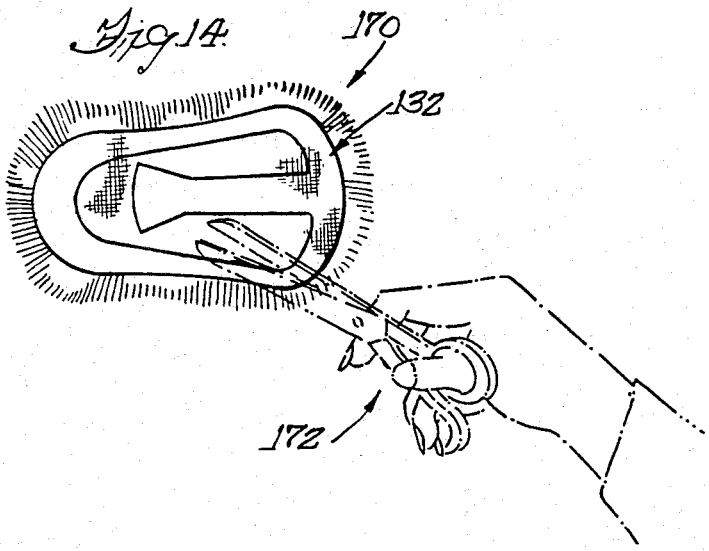
FIG. 14 is a reduced top plan view of a final step in the process of fabrication of a hairpiece in accordance with the second embodiment of the invention.
Figure 15:
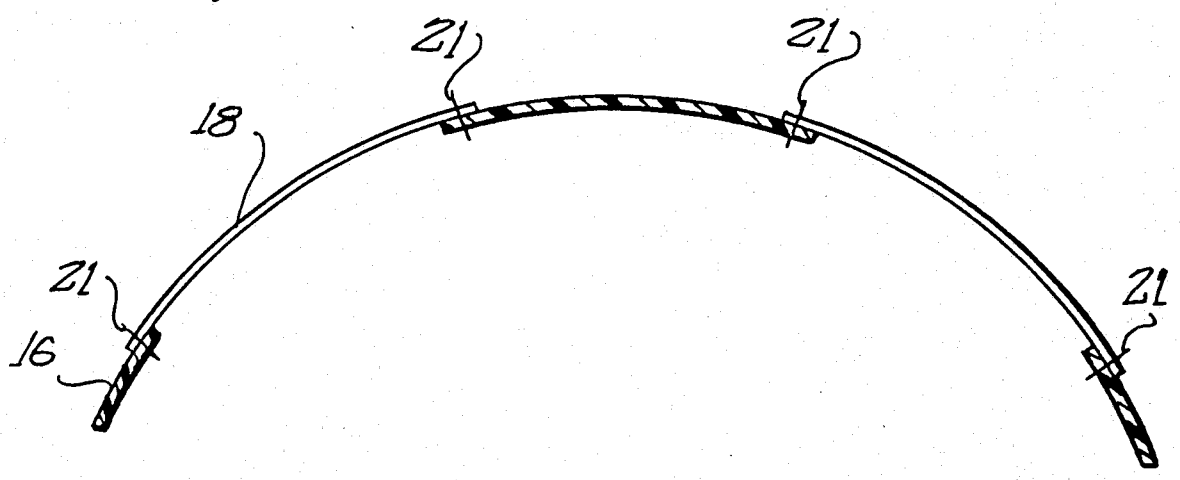
FIG. 15 is a cross-sectional view taken along line 15—15 in FIG. 2.

Referring briefly to FIG. 14, excess peripheral portions of the sheet member 116 and of the reticulate sheets 128 and 130 may be trimmed from the periphery or perimeter of the finished hairpiece, now designated generally by reference numeral 170, as indicated in phantom line at 172, to more closely conform to the surface of the user's head to be fitted.

While particular embodiments of the invention have been shown and described in detail, it will be obvious to those skilled in the art that changes and modifications of the present invention, in its various aspects, may be made without departing from the invention in its broader aspects some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. In a hairpiece, the combination comprising a foundation including a one-piece flexible molded plastic sheet member having a shape substantially to conform to the head of a wearer and having a single hole therethrough extending across from about 20 to 60 percent of the area of the foundation for facilitating dissipation of heat and perspiration generated by the wearer, said plastic sheet member including an annular marginal portion and an integral transverse portion partially traversing said hole, reticulate sheet means joined to said flexible plastic sheet member along a margin of said hole and covering said hole, and hairs secured directly to said reticulate sheet means and said plastic sheet member, said foundation plastic sheet member and reticulate sheet means being free of overlying material save for said hairs.

2. The combination according to claim 1 wherein said hole is substantially U-shaped, said plastic sheet transverse portion being integral with said marginal portion and partially traversing said hole to define said U-shape thereof.

3. The combination according to claim 1 wherein said reticulate sheet means comprises a plurality of sheet means covering said hole.

4. The combination according to claim 1 wherein said reticulate sheet means comprises at least two reticulate sheets in overlying and offset relation to one another.

5. The combination according to claim 1 wherein said reticulate sheet means is substantially co-extensive with said flexible plastic sheet member and further including means bonding said reticulate sheet means to said marginal surface portion.

6. The combination according to claim 1 wherein said reticulate sheet means is preshaped to conform to the contour of said given surface of a user's head.

7. The combination according to claim 1 wherein the flexible sheet member is polyester-based thermoplastic polyurethane film having a thickness of substantially on the order of 4 mils.

8. The combination according to claim 1 which includes bonding means comprising a silicone rubber sealant material joining said plastic sheet member and said reticulate sheet means.

9. The combination according to claim 8 wherein said bonding means further bonds said reticulate sheet means to said transverse portion of said flexible sheet member.

10. The combination according to claim 1 and further including a quantity of adhesive material for further securing said hair strands to the flexible sheet member.

11. The combination according to claim 10 wherein said adhesive comprises an anaerobic ethyl cyanoacrylate.

12. The combination according to claim 10 and further including smooth coating means applied to the inner surface of said flexible sheet member.

13. The combination according to claim 12 wherein said smooth coating comprises a thermoplastic urethane coating.

14. The combination according to claim 1 wherein said reticlate sheet means comprises molded monofilament nylon having a shape complimentary to that of the molded plastic sheet member to conform to the head of a wearer.

15. A method for making a hairpiece comprising: forming a thin flexible plastic sheet member to a predetermined contour conforming substantially to the contour of a given surface of a user's head, and to define an inner surface and an outer surface; cutting out at least one predetermined internal portion of said sheet member comprising from about 20 to 60 percent of the area thereof, to leave a predetermined open area therein surrounded by at least a margin portion of said sheet member; applying reticulate sheet means overlying said open area and said outer surface of said flexible sheet member margin portion; forming said reticulate sheet means to the contour of said given surface of a user's head; applying bonding means to bond together said reticulate sheet means and the outer surface of said flexible sheet member margin portion, and securing hair directly to said reticulate sheet means and said plastic sheet member and leaving said plastic sheet member and said reticulate sheet means free of overlying material save for said hair.

16. A method according to claim 15 and further including, prior to the step of applying said bonding means, applying a primer to the portions of said reticulate sheet means and of said outer surface of said sheet member margin portion to which said bonding means is to be applied.

17. A method according to claim 16 and further including the steps of oven curing said flexible sheet member and said reticulate sheet means for a predetermined length of time and at a predetermined temperature following application of said primer thereto and the further step of oven curing said flexible sheet member and said reticulate sheet means for a second predetermined length of time at a second predetermined temperature following application of said bonding means thereto.

18. A method according to claim 17 wherein said first predetermined time is substantially on the order of 30 minutes, wherein said second predetermined time is substantially on the order of one hour and wherein said first and second predetermined temperatures are both substantially on the order of 160 degrees fahrenheit.

19. A method according to claim 15 and further including applying an adhesive to said inner surface of said flexible sheet member to secure the hair strands in place; and applying a coating material to the inner surface of the flexible sheet member margin portion to form a smooth coating on said inner surface.

20. A method according to claim 19 wherein the step of applying said coating material includes applying at least two layers of said coating material and the further step of curing the first layer of said coating material prior to applying the second layer of coating material, and thereafter curing the second layer of coating material.

21. A method according to claim 20 wherein both of said curing steps further comprise curing each said coating layer with a stream of warm forced air at a temperature insufficient to re-heat or re-shape either of said reticulate sheet means.

22. A method according to claim 15 wherein the steps of applying and forming said reticulate sheet means include first softening the reticulate sheet means and then first stretching the reticulate sheet means over said flexible sheet members upon a form and thereafter heat shrinking said reticulate sheet means.

23. A method according to claim 22 wherein said heat shrinking comprises placing said form with said reticulate sheet means stretched thereon in an oven at a temperature of substantially on the order of 160 degrees farenheit for a time of substantially on the order of one hour.

24. A method according to claim 15 wherein the step of cutting comprises cutting a substantially U-shaped opening in said flexible sheet member to thereby define a generally annular margin portion having a transverse tongue-like inward extension.

25. A method according to claim 15 wherein the steps of applying and forming said reticulate sheet means further comprises softening and stretching in sequence two reticulate sheets of monofilament nylon material over said flexible sheet member upon a form and thereafter heat shrinking both of said reticulate sheets.

* * * * *